US007048599B1

(12) United States Patent
Garwood et al.

(10) Patent No.: US 7,048,599 B1
(45) Date of Patent: May 23, 2006

(54) MANUALLY PROPELLED WATERCRAFT AND PROPULSION MECHANISM

(75) Inventors: Clint Garwood, Chicago, IL (US); Tracy Tepper, Chicago, IL (US)

(73) Assignee: Hydro-Blade, Inc., Bloomingdale, IL (US)

( * ) Notice: Subject to any disclaimer, the term of this patent is extended or adjusted under 35 U.S.C. 154(b) by 0 days.

(21) Appl. No.: 10/905,260

(22) Filed: Dec. 22, 2004

(51) Int. Cl.
*B63H 16/00* (2006.01)

(52) U.S. Cl. ..... 440/21; 441/76

(58) Field of Classification Search ..... 440/17, 440/21, 25, 19, 91, 92; 441/76, 77
See application file for complete search history.

(56) References Cited

U.S. PATENT DOCUMENTS

| | | | | |
|---|---|---|---|---|
| 1,533,023 A | | 4/1925 | Meredith | |
| 1,692,055 A | * | 11/1928 | Sheldon | 441/77 |
| 2,297,493 A | | 9/1942 | Pomilio | |
| 3,242,898 A | | 3/1966 | Livaudais | |
| 3,835,494 A | | 9/1974 | Dougherty | |
| 4,157,597 A | * | 6/1979 | Trebnick | 441/76 |
| 4,846,743 A | | 7/1989 | Ping-chuan | |
| 4,952,184 A | | 8/1990 | Graziano | |
| 5,080,621 A | | 1/1992 | Nayes | |
| 5,194,023 A | | 3/1993 | Stone | |
| 5,458,514 A | | 10/1995 | Hsia | |
| 5,669,793 A | * | 9/1997 | Walton | 440/25 |
| 5,697,822 A | | 12/1997 | Souter | |
| 6,595,813 B1 | | 7/2003 | Lekhtman | |
| 6,764,363 B1 | | 7/2004 | Rosen | |

FOREIGN PATENT DOCUMENTS

JP 55-119588 * 9/1980

* cited by examiner

*Primary Examiner*—Ed Swinehart
(74) *Attorney, Agent, or Firm*—Seyfarth Shaw LLP

(57) ABSTRACT

A manually propelled watercraft for transporting a user on water, comprising a buoyant body having a longitudinal axis and a top side and a bottom side disposed adjacent to the water, a track disposed on the body substantially parallel to the longitudinal axis, a vehicle having a bottom side and being slidably coupled to the track and movable to and from first and second positions relative to the body, and a fin coupled to the bottom side of the vehicle and being movable to and from an extended position that is inclined relative to the longitudinal axis and a retracted position that is substantially parallel to the longitudinal axis, wherein when the vehicle is moved from the first position to the second position, the first fin is substantially disposed in the extended position to maximize water resistance for propulsion of the body, and when the first vehicle is moved from the second position to the first position, the first fin is substantially disposed in the retracted position to minimize water resistance.

25 Claims, 12 Drawing Sheets

MANUALLY PROPELLED WATERCRAFT AND PROPULSION MECHANISM

BACKGROUND OF THE INVENTION

The present invention relates generally to manually propelled personal watercraft devices and, more particularly, to watercraft devices that are manually propelled by the natural bipedal walking movement of a user.

Manually propelled watercraft devices, such as row boats, paddle boats and the like, are well-known. However, in all such devices, the user is generally in a seated position and thus must impart unnatural, device-specific movement to propel the boat, such as a rowing motion or paddle wheel motion with rotating pedals on a crank arm similar to a bicycle.

There have been some attempts to utilize cross-country skiing motion, while the user is in a substantially upright position in order to mimic a more natural movement, to propel a boat. However, it is often difficult for the user to maintain his balance or the device translating the cross-country skiing motion requires complicated mechanisms to propel the boat. For example, U.S. Pat. No. 5,194,023 discloses a recreational watercraft that can be propelled by a user performing a cross-country skiing action by simultaneously moving both his feet and arms in a well-known, cross-country skiing-like manner. However, the watercraft uses a complicated cable and pulley system in order to translate the cross-country skiing action into propulsion for the watercraft. Further, only one arm and foot combination can be used at a time, while the other arm and foot combination remain in a locked position towards the front of the craft.

BRIEF SUMMARY OF THE INVENTION

The present application discloses a manually propelled personal watercraft that utilizes the natural bipedal walking or running motion of a user to propel the watercraft. As such, the user remains in a substantially upright, standing-like position while using the watercraft. In an embodiment, the watercraft includes a buoyant body with a track that slidably receives a vehicle that is adapted to be coupled to a user's foot. The vehicle is adapted to move to and from first and second positions relative to the body. A fin is pivotally coupled to a bottom side of the vehicle and is pivotable to and from an extended position that is inclined relative to the body and a retracted position that is substantially parallel to the body. When the vehicle is moved from the first position to the second position, the fin is pivoted from the retracted position to the extended position to maximize water resistance for propulsion of the watercraft. When the vehicle is moved from the second position to the first position, the fin is automatically pivoted to the retracted position in order to minimize water resistance.

In an embodiment, the watercraft includes two, substantially reciprocally identical track and vehicle combinations. As such, while one vehicle is moved from the first position to the second position, the other vehicle may be reciprocally moved from the second position to the first position, similar to a natural walking or running motion wherein one foot moves forwardly while the other foot moves rearwardly.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
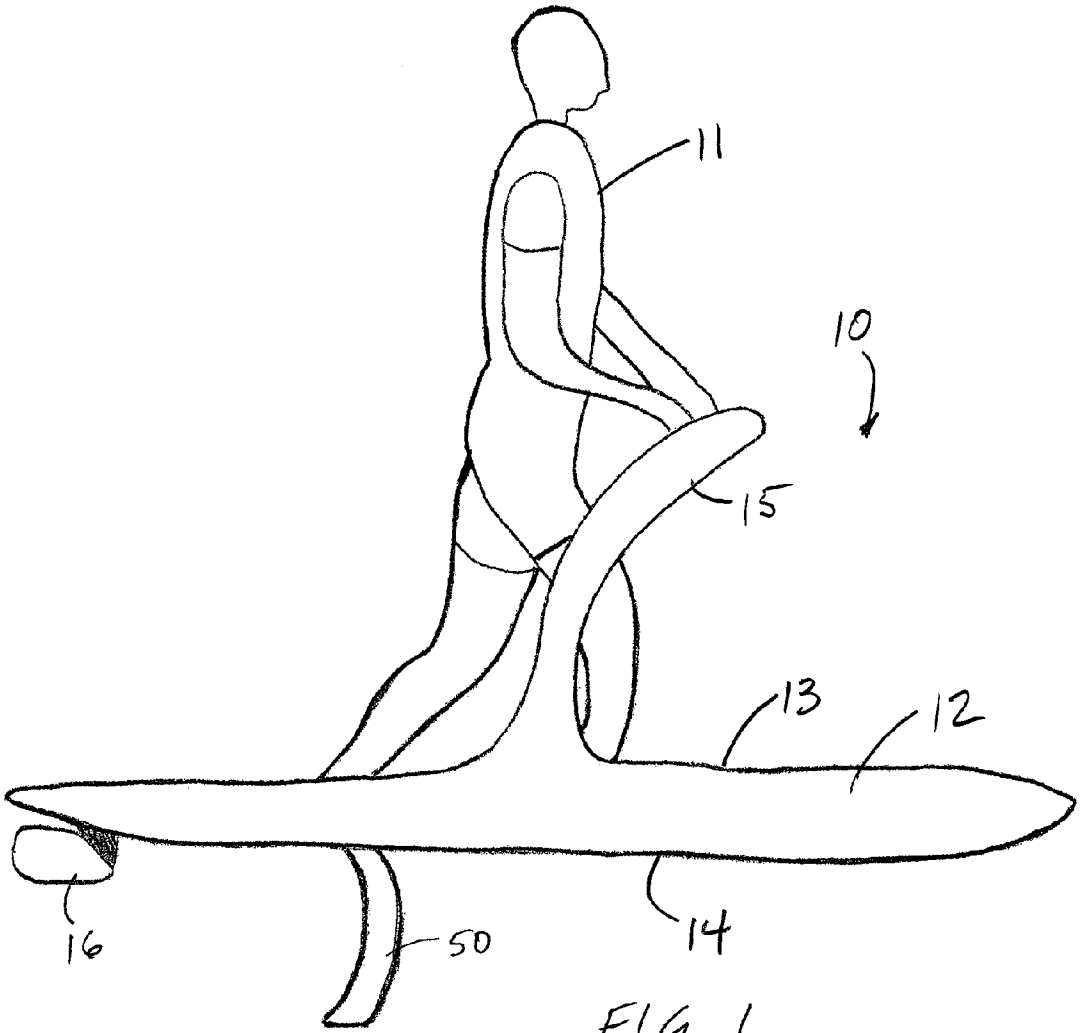
FIG. 1 is a side elevational view of a watercraft of the present application.

Referring to FIG. 1, an embodiment of the manually propelled watercraft device, generally referred to as numeral 10, is shown. In an embodiment, the watercraft is adapted to transport a user 11 on a body of water while the user 11 is preferably in a substantially upstanding position. The watercraft 10 may propel the user in any direction, preferably in a substantially forwardly direction, relative to the watercraft.

The watercraft includes a body 12 that is adapted to support the user 11. In an embodiment, the body 12 may be buoyant. Body 12 has a longitudinal axis and a top side 13 adapted to support the user 11 and a bottom side 14 that is substantially adjacent to the surface of the water. In an embodiment, the body 12 includes a substantially upstanding handle bar 15 disposed on the top side 13 of the body 12.

Figure 2:
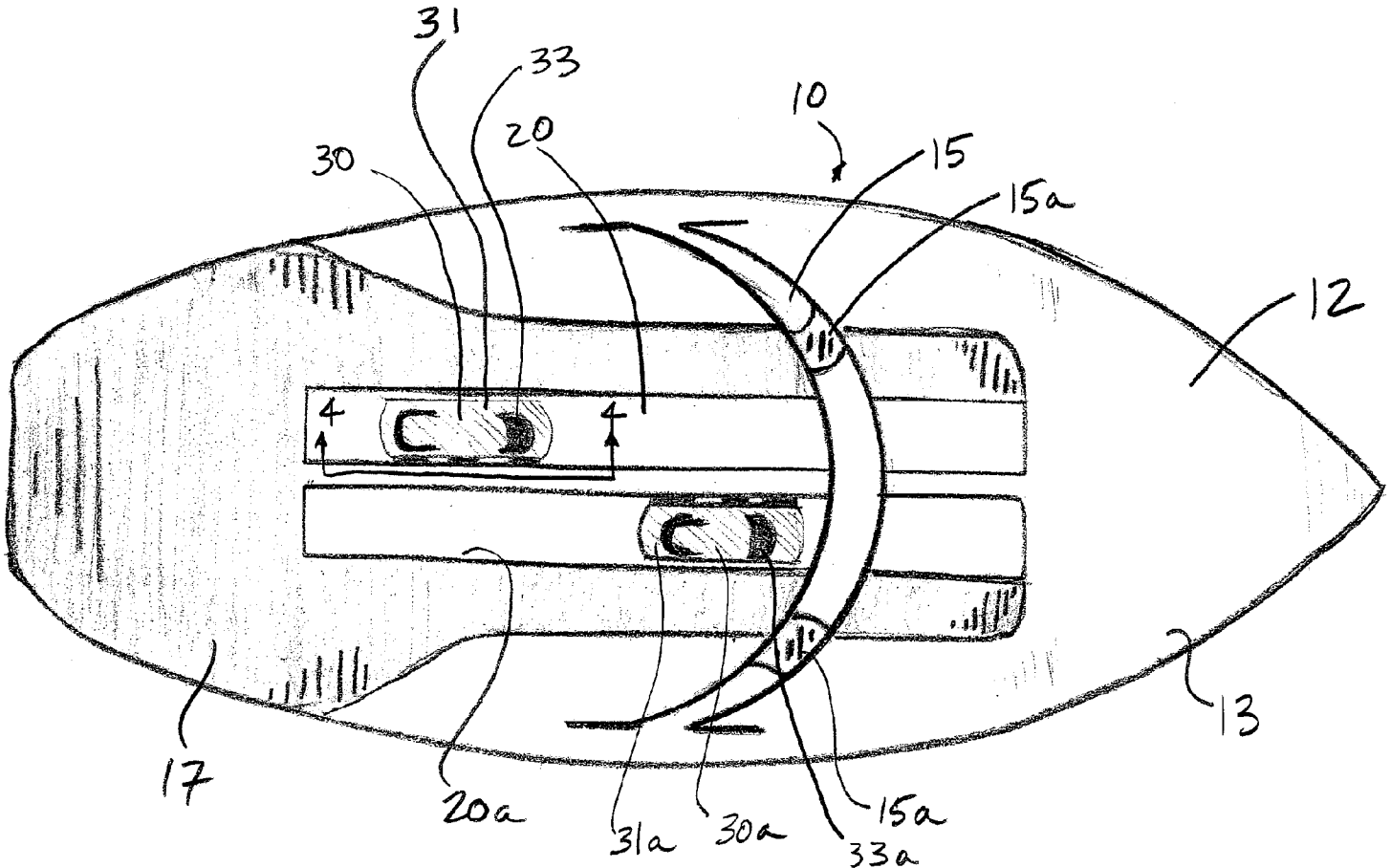
FIG. 2 is an enlarged top view of the watercraft of FIG. 1.

The handle bar 15 may be disposed in a position and sized such that it is easily grasped by the user 111 in a well-known manner and may include grip locations 15*a* (FIG. 2). In another embodiment, the handle bar 15 may be arcuate in form. In yet another embodiment, a rudder structure 16 may be pivotally coupled to the bottom side 14 of the body 12 in a well-known manner for directional manipulation of the watercraft 10. The rudder structure 16 may be operably coupled to a hand actuated rudder control mechanism disposed on the handle bar 15 adjacent to either or both of the grip locations 15*a* for manual actuation by the user 11.

Figure 3:
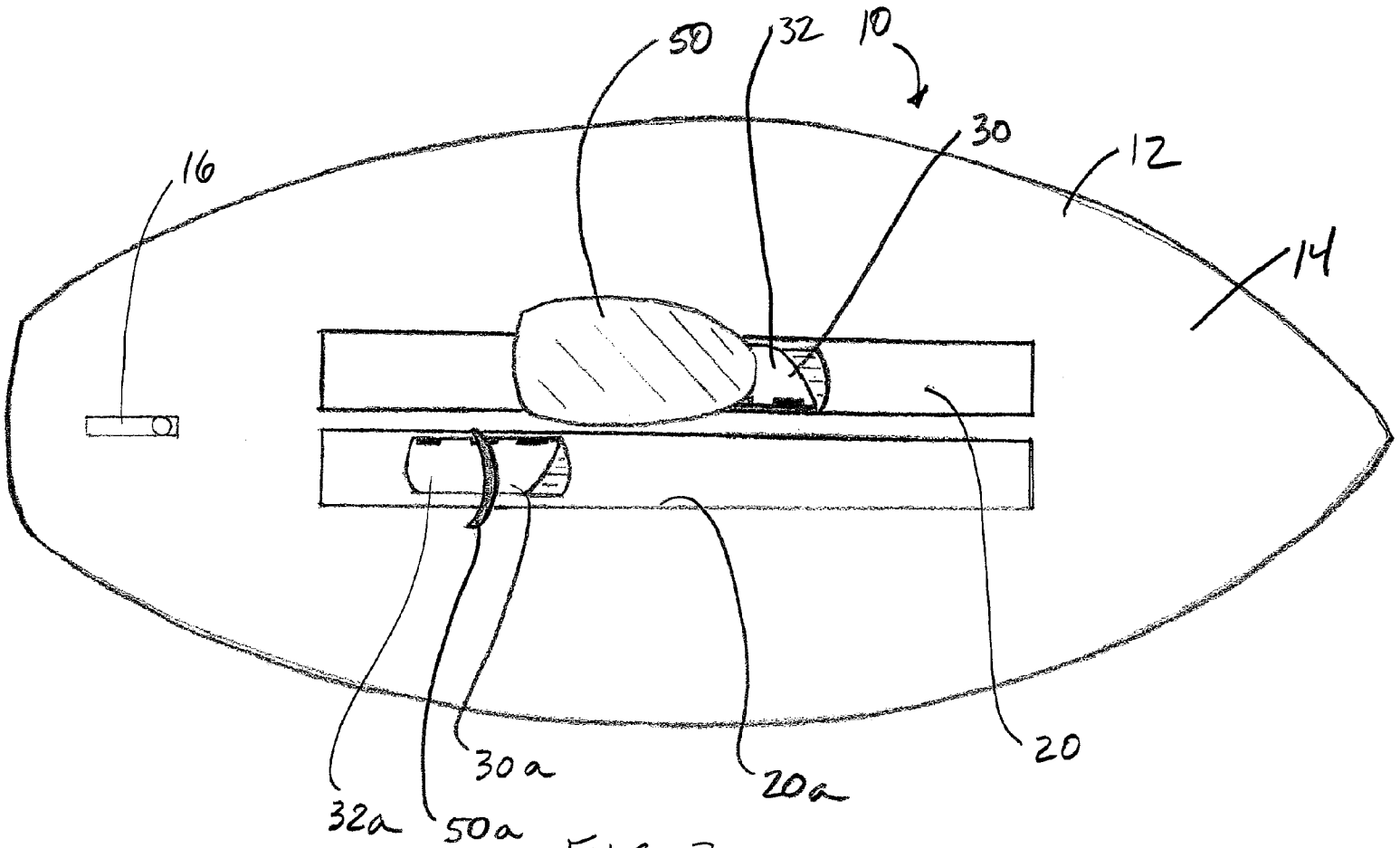
FIG. 3 is an enlarged bottom view of the watercraft of FIG. 1.

Referring also to FIGS. 2 and 3, the body 12 may include a platform 17 that is adapted to support the user 11 while the user 11 mounts and dismounts the watercraft 10. In an embodiment, the platform 17 may include a non-slip or grip-enhancing surface.

Figure 4:
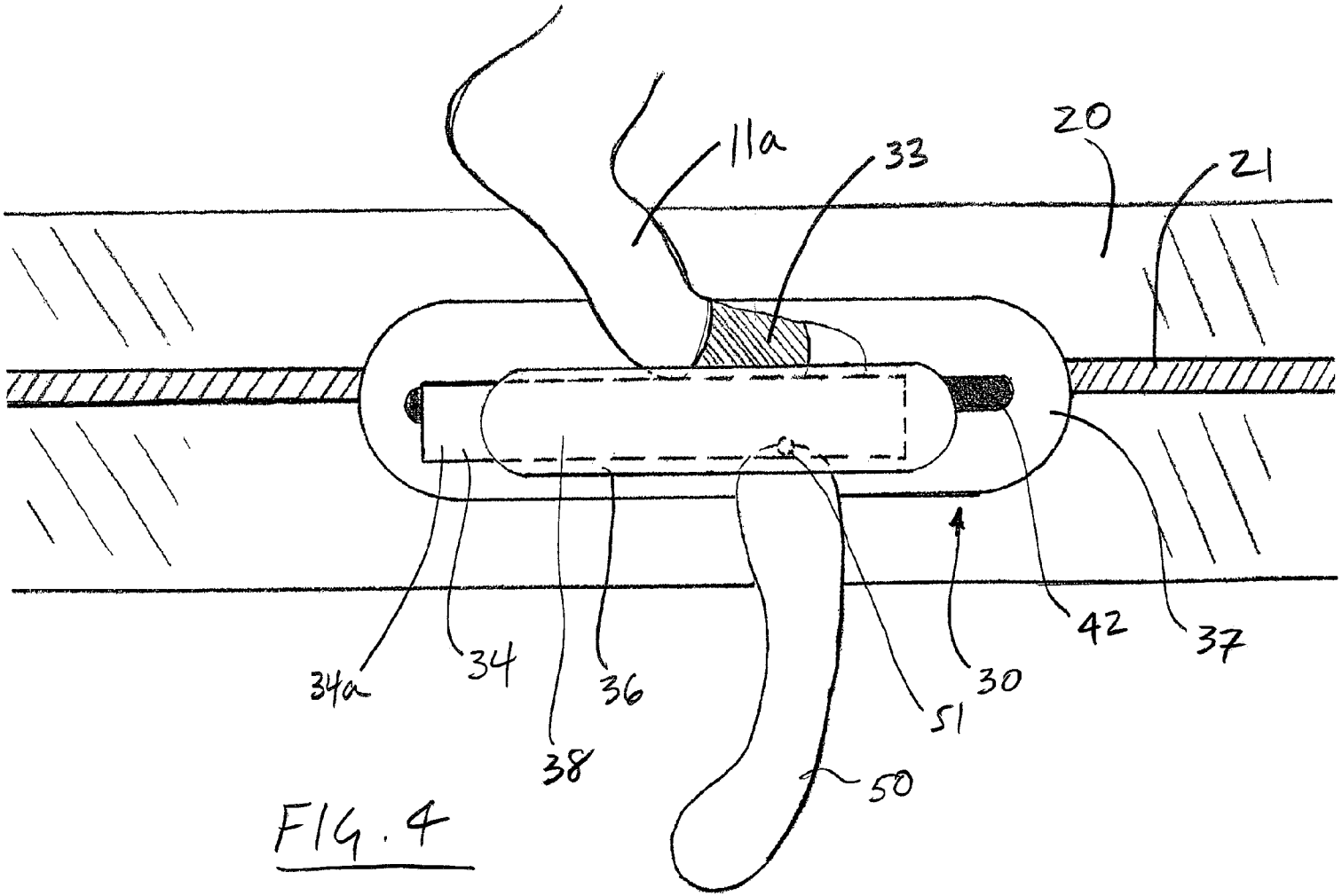
FIG. 4 is an enlarged cross-sectional view of the watercraft of FIG. 2, taken generally along line 4—4 in FIG. 2, showing the fin disposed substantially in the extended position.

The body 12 includes a first track 20 disposed substantially parallel to the longitudinal axis of the body 12. A first vehicle 30 is slidably coupled to the first track and is movable to and from first and second positions relative to the body 12. The vehicle 30 includes a top side 31 and a bottom side 32 that is substantially adjacent to the surface of the water. The first position may correspond to a position disposed forwardly relative to the body 12, and the second position may correspond to a position rearwardly relative to the body 12. The top side 31 is adapted to be coupled to the user's foot 11*a* and may include a foot strap 33 to securely couple the user's foot 11*a*, as seen in FIG. 4. In an embodiment, the top side 31 includes a non-slip or grip enhancing surface.

Figure 5:
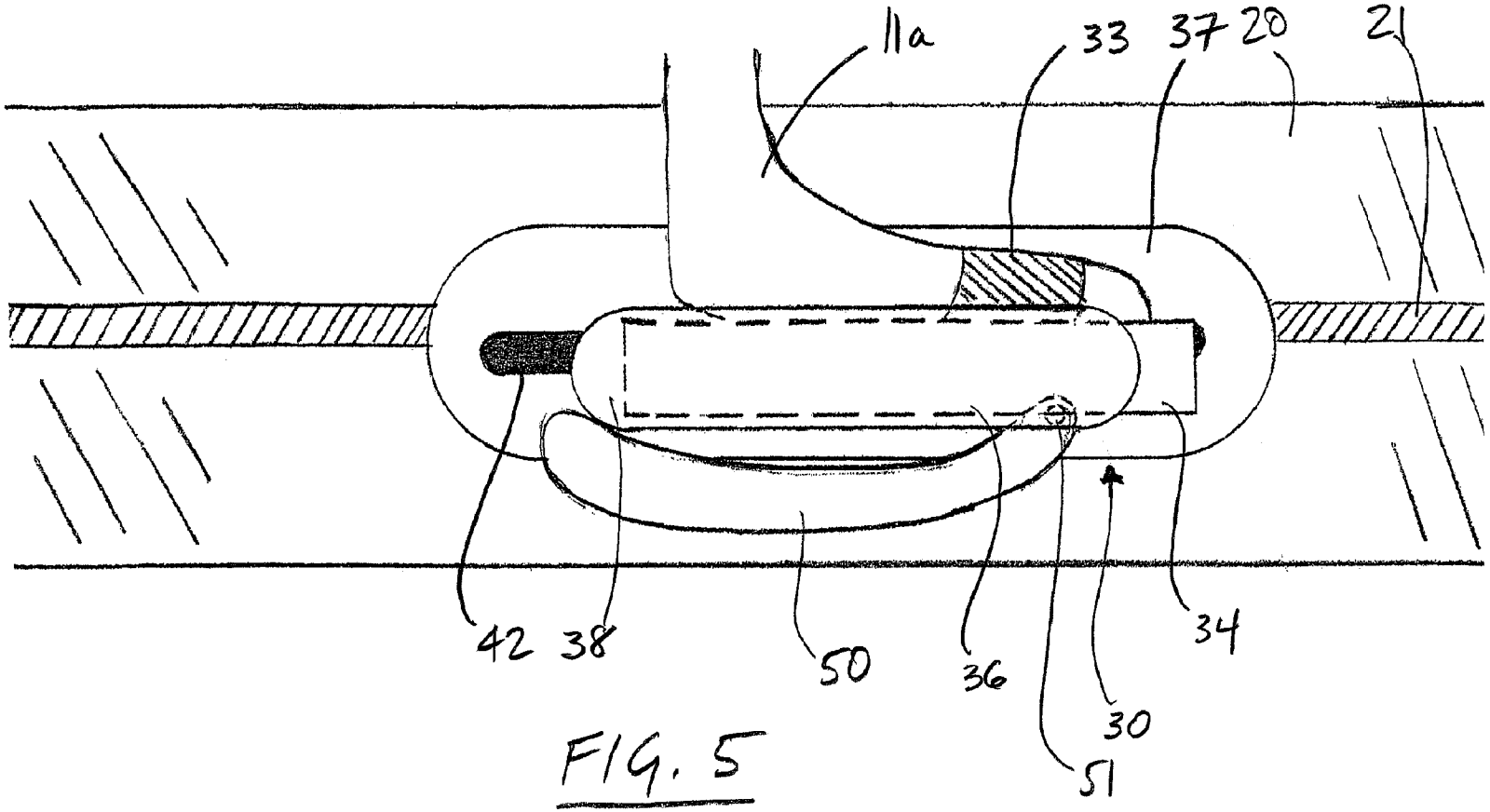
FIG. 5 is a view similar to FIG. 4, but showing the fin disposed substantially in the retracted position.
Figure 6:
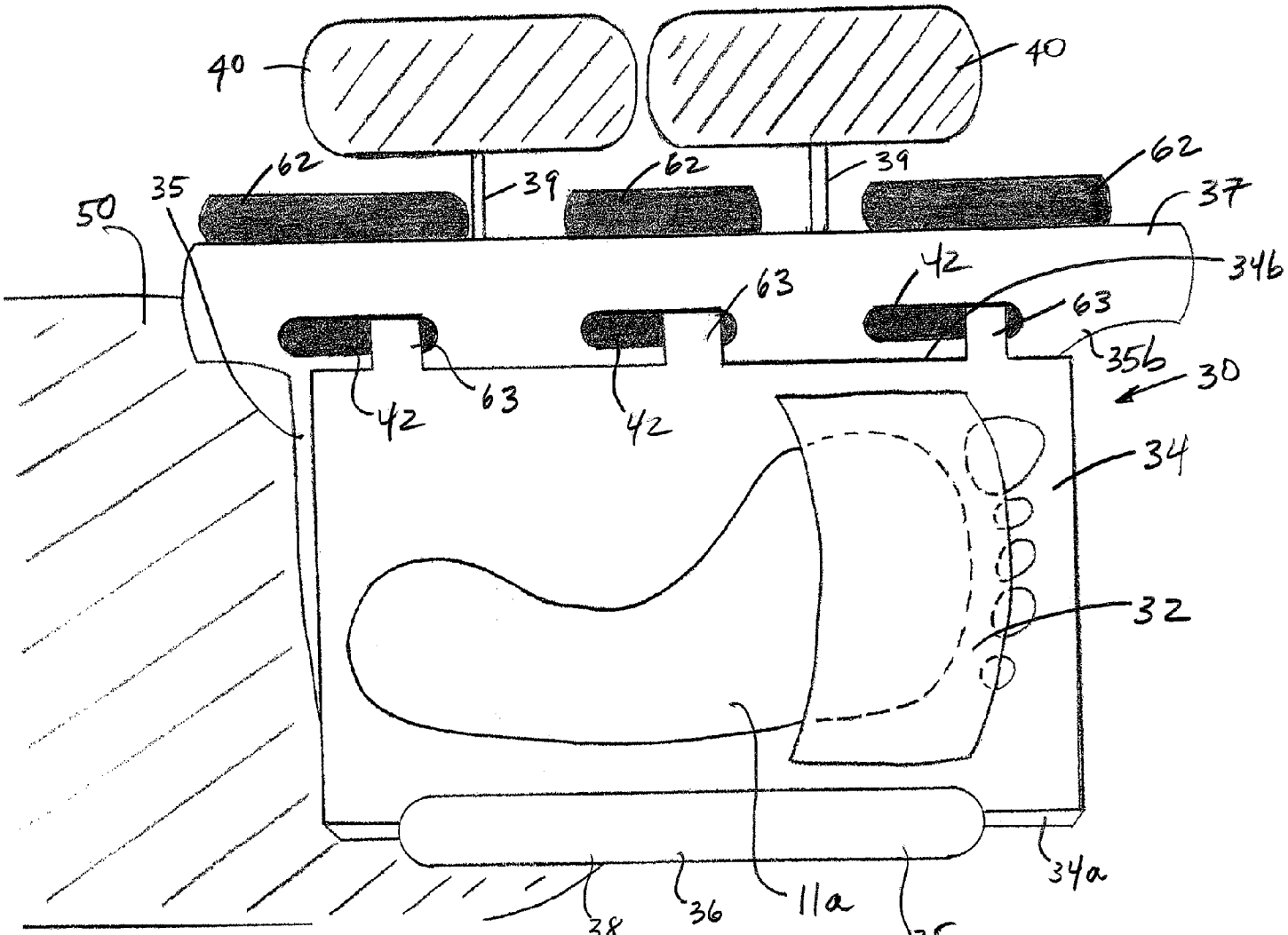
FIG. 6 is an enlarged top view of an embodiment of the vehicle and fin of the present application, showing the fin disposed substantially in the retracted position.

A first fin 50 is pivotally coupled to the bottom side 32 of the first vehicle 30. The fin 50 is pivotable or movable to and from an extended position that is inclined relative to the longitudinal axis of the body 12 (as seen in FIG. 4) and a retracted position that is substantially parallel to the longitudinal axis of the body 12 (as seen in FIG. 5). When the first vehicle 30 is moved from the first position to the second position, the fin 50 is moved substantially to the extended position in order to maximize water resistance while the vehicle 30 and fin 50 are moved rearwardly to the second position, relative to the body 12, thus causing a propulsion force that moves the watercraft 10 along a substantially forwardly directed vector. When the vehicle 30 is moved from the second position to the first position, the fin 50 is moved substantially to the retracted position to minimize water resistance while the vehicle 30 and fin 50 are moved forwardly, relative to the watercraft 10, thus allowing the vehicle 30 and fin 50 to move to the first position while having minimal impact on the watercraft's 10 forwardly movement.

In an embodiment, the watercraft 10 includes a second track 30*a* that is substantially reciprocally identical in form and design as the first track 30, and is disposed on the body 12 in substantial parallel relation to the first track 30. A second vehicle 30*a* may be slidably coupled to the second track 30*a* and, substantially like the first vehicle 30, is movable to and from first and second positions relative to the body 12 and has a top side 31*a* and a bottom side 32*a*. A second fin 50*a* is pivotally coupled to the bottom side 32*a* of the second vehicle 30*a*. The second fin 50*a*, substantially like the first fin 50, is pivotable to and from an extended position that is inclined relative to the longitudinal axis to maximize water resistance and a retracted position that is substantially parallel to the longitudinal axis to minimize water resistance. The top side 31*a*, like the top side 31 of the first vehicle 30, is adapted to be coupled to the user's foot and may include a foot strap 33*a* to securely couple the user's foot 11*a* thereto.

In an embodiment, when the first vehicle 30 is moved from the first position to the second position, thus propelling the watercraft 10 in a substantially forwardly directed vector, the second vehicle may be reciprocally moved from the second position to the first position, thus mimicking a natural bi-pedal walking or running motion by the user 11.

Accordingly, it will be appreciated that the form, construction and operation of the second track 20*a*, second vehicle 30*a* and second fin 50*a*, including their respective components, are substantially identical to that of the first track 20, first vehicle 30 and first fin 50. As such, it is to be understood that, while referring only to any one of the tracks, vehicles and fins, the other of the tracks, vehicles and fins has substantially the identical structure, form or construction, although not explicitly recited herein.

Referring to FIG. 4, in an embodiment, the track 20 may include a channel 21, having two transversely opposing sidewalls and a back wall.

Figure 8:
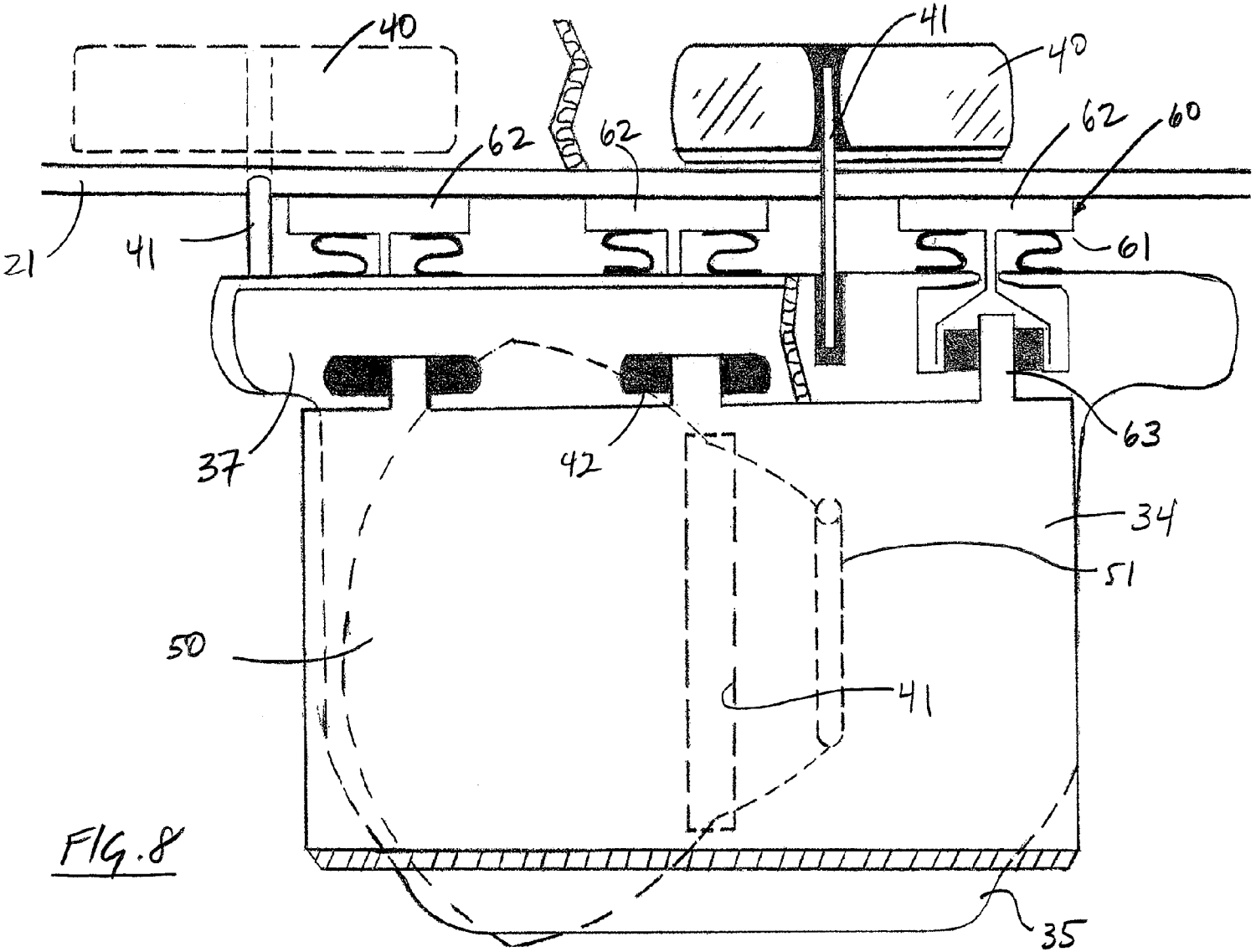
FIG. 8 is a view similar to FIG. 7, but showing the fin disposed between the extended and retracted positions and the upper platform between the forward and rearward positions.
Figure 9:
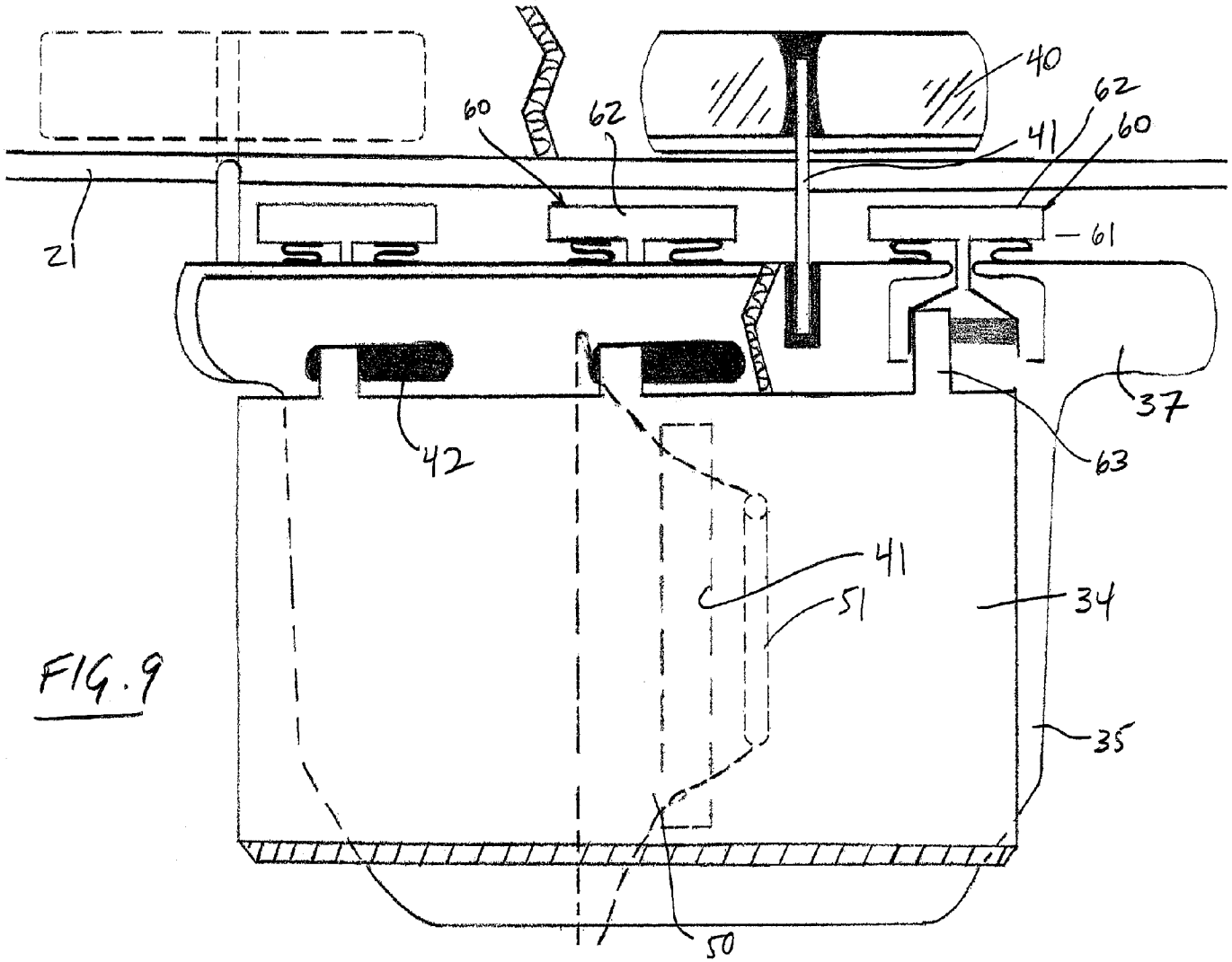
FIG. 9 is a view similar to FIG. 7, but showing the fin disposed substantially in the extended position and the upper platform disposed in the rearward position.
Figure 10:
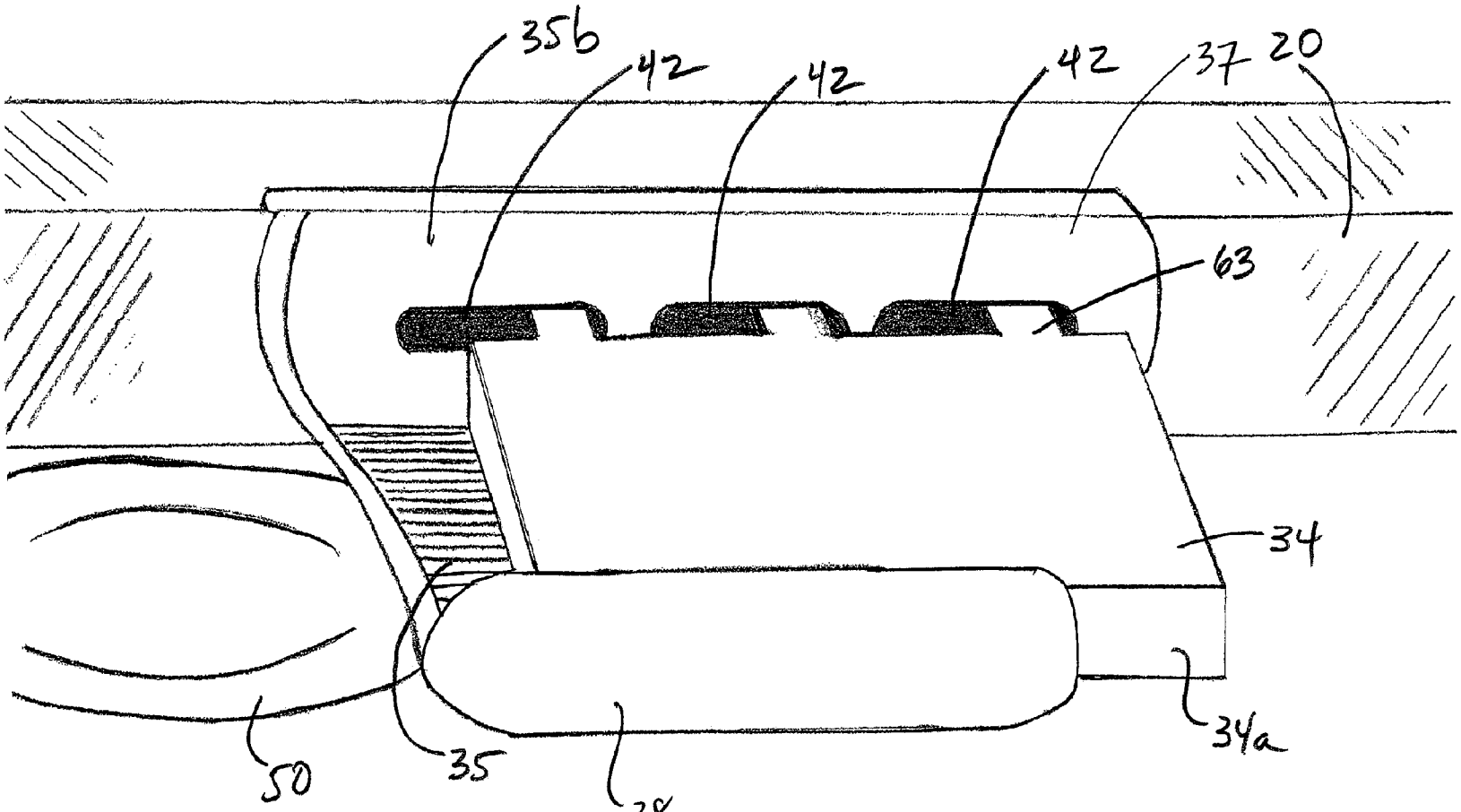
FIG. 10 is a reduced perspective side view of the vehicle and fin of FIG. 6.
Figure 11:
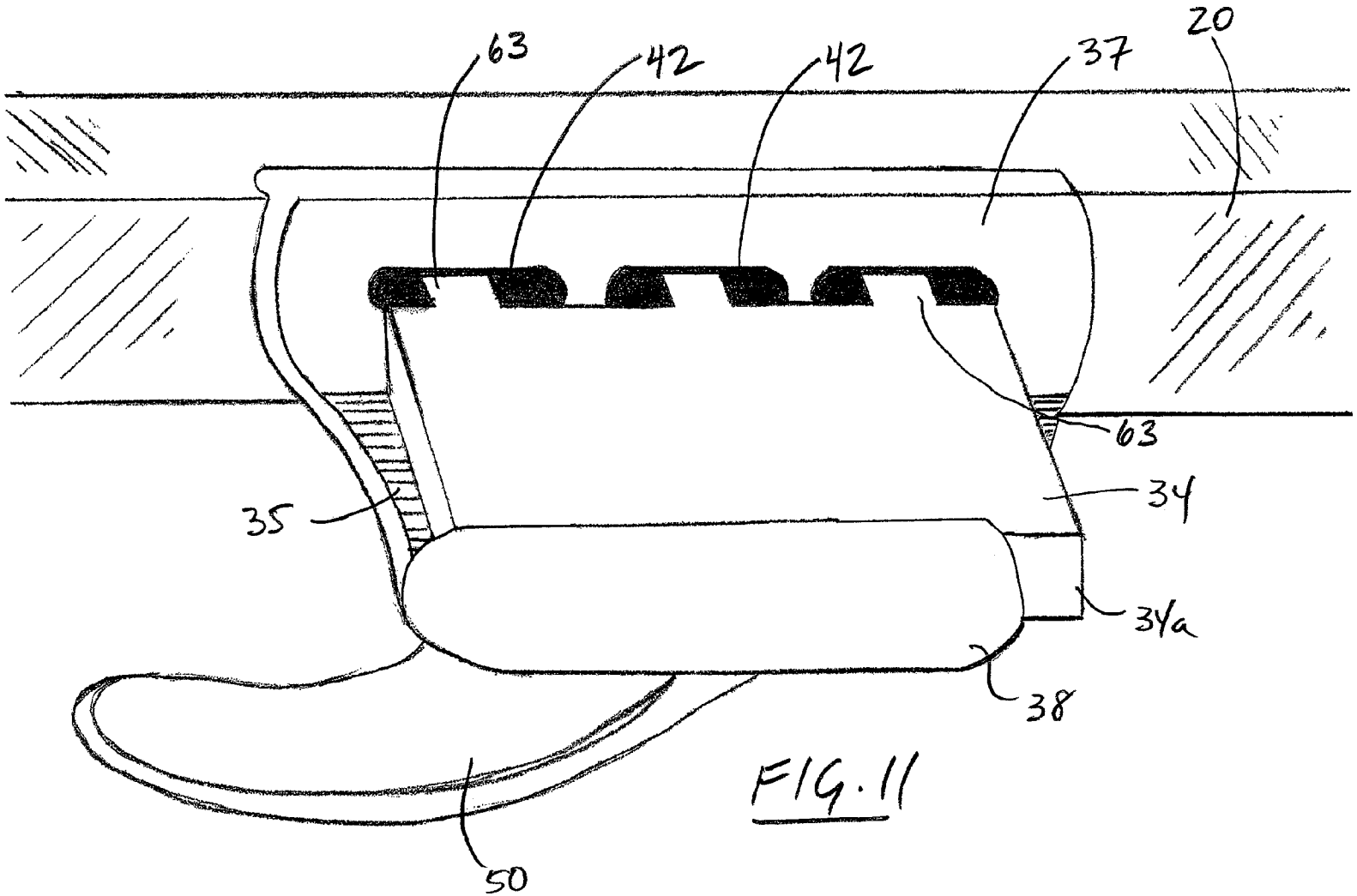
FIG. 11 is a view similar to FIG. 10, but showing the fin disposed between the retracted and extended positions and the upper platform disposed between the rearward and forward positions.
Figure 12:
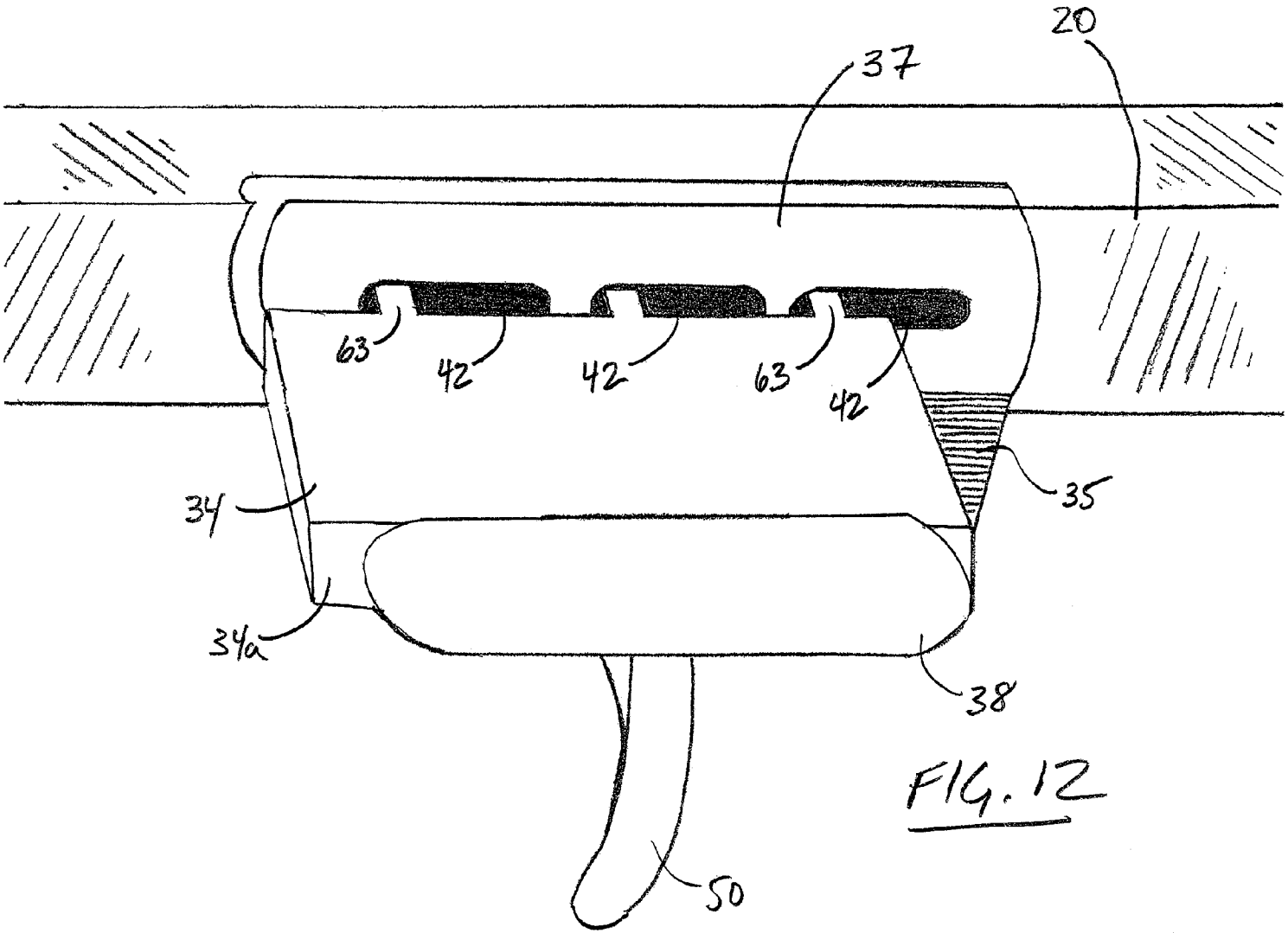
FIG. 12 is a view similar to FIG. 10, but showing the fin disposed substantially in the extended position and the upper platform disposed substantially in the rearward position.

Referring also to FIGS. 5–12, the vehicle 30 may include an upper platform 34 and a lower platform 35 in substantially superimposed relation to each other. The upper platform 34 may have the foot strap 33 secured thereto for securely coupling the user's foot 11*a* to the vehicle 30. The upper platform 34 has sides 34*a*, 34*b*, and the lower platform 35 has sides 35*a*, 35*b*. The upper platform 34 is slidable to and from a forward position, relative to the lower platform 35 (FIG. 10), and a rearward position, relative to the lower platform 35 (FIG. 12). The upper surface of the lower platform 35 and the bottom surface of the upper platform 34, may include a slip-enhancing or friction-reducing material. When the upper platform 34 is disposed in substantially the forward position, relative to the lower platform 35, the fin 50 is disposed substantially in the retracted position. (FIG. 10). When the upper platform 34 is disposed substantially in the rearward position, the fin 50 is disposed substantially in the extended position. (FIG. 12). Accordingly, when the upper platform 34 is moved from the forward position to the rearward position, the fin 50 is moved from the retracted position to the extended position. Likewise, when the upper platform 34 is moved from the rearward position to the forward position, the fin 50 is moved from the extended position to the retracted position.

The upper and lower platforms, 34, 35, may be substantially oblong in shape. As such, the upper platform 34 defines transversely opposing elongated outer edge 34*a* and inner edge 34*b*, and the lower platform defines transversely opposing elongated outer edge 35*a* and inner edge 35*b*, wherein the inner edges 34*a*, 35*a*, are disposed adjacent to the channel 21. In an embodiment, the upper platform 34 may have a width that is slightly less than the width of the lower platform 35. The lower platform 35 may include a guide 36. The guide 36 includes an inner upstanding wall 37 disposed on the inner edge 35*b* of the lower platform 35, and an outer upstanding wall 38 disposed on the outer edge 35*a* of the lower platform 35. Accordingly, the guide 36 is adapted to prevent lateral movement of the upper platform 34 relative to the lower platform 35.

In an embodiment, the inner upstanding wall 37 includes an outwardly projecting axle 39 coupled to a wheel 40 that is adapted to be disposed within the channel 21. In an embodiment, the inner upstanding wall 37 includes a plurality of outwardly projecting axles 39, each coupled to a wheel 40, wherein the wheels 40 are in substantial rotational alignment.

The lower platform 35 includes an aperture 41 disposed in substantially the middle thereof. The aperture 41 may be oblong, wherein the elongated sides of the aperture are disposed substantially laterally relative to the elongated sides of the upper and lower platforms 34, 35. The fin 50 is pivotally coupled to the bottom side of the upper platform and extends through the aperture 41. The fin 50 may be pivotally coupled with, for example, a hinge or the like.

The forward peripheral edge 41*a* of the aperture abuts the fin 50 to cause the fin 50 to move from the extended position to the retracted position when the upper platform 34 moves from the rearward position to the forward position, relative to the lower platform 35. When the upper platform 34 is disposed in the forward position, a continued forwardly directed force imparted to the upper platform 34, from the user's foot 11*a*, causes the upper platform 34, lower platform 35 and fin 50, which is disposed in substantially the retracted position, to move unitarily towards the first position.

The rearward peripheral edge 41*b* of the aperture 41 abuts the fin 50 to cause the fin 50 to move from the retracted position to the extended position when the upper platform 34 moves from the forward position to the rearward position, relative to the lower platform 35. When the upper platform 34 is disposed in the rearward position, a continued rearwardly directed force imparted to the upper platform 34, from the user's foot 11*a*, causes the upper platform 34, lower platform 35 and fin 50, which is disposed in substantially the extended position, to move unitarily towards the second position, thus propelling the watercraft 10 along a substantially forwardly directed vector, due to water resistance caused by the fin 50.

Figure 7:
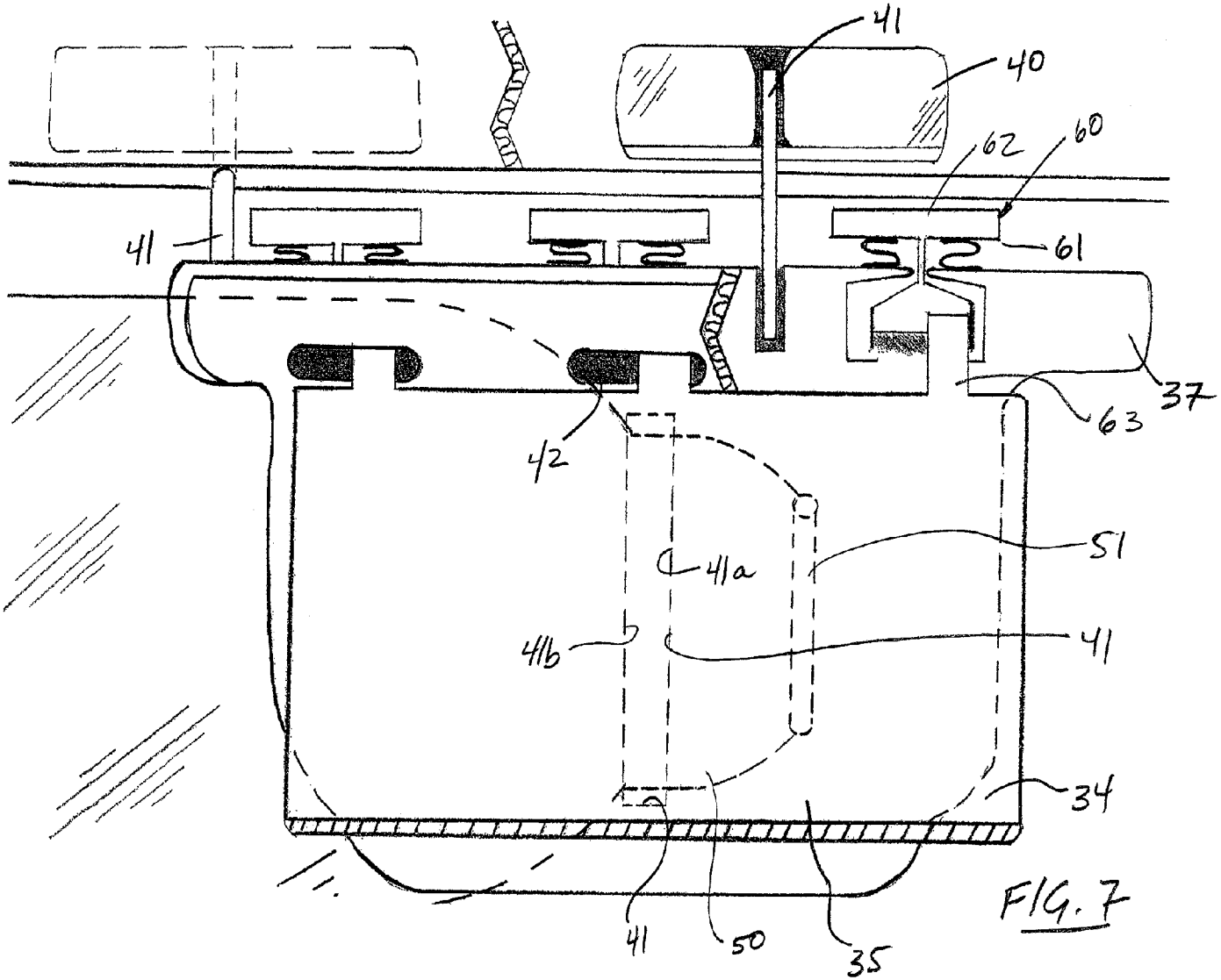
FIG. 7 is a top view of the vehicle and fin of FIG. 6 with a portion broken away and the foot strap removed, and showing the fin disposed substantially in the retracted position and the upper platform disposed in the forward position.

The vehicle 30 may include a detent structure 60 for detentable engagement with the channel 21. The detent mechanism 60 may be coupled to the inner upstanding wall 37 of the lower platform 35 and is operably coupled to the upper platform 34. The detent structure 60 is releasable when the upper platform 34 is disposed substantially in either the forward position or the rearward position, relative to the lower platform 35. (FIGS. 7 and 9). The detent mechanism 60 is engageable, thus detentably detaining the position of the lower platform 35 relative to the channel 21, when the upper platform 34 is moved or disposed between the forward and rearward positions. (FIG. 8). Accordingly, the detent mechanism 60 temporarily detains the position of the lower platform 35, relative to the channel 21, while the fin 50 is moved from the extended position to the retracted position or while the fin 50 is moved from the retracted position to the extended position, caused by the relative movement between the upper and lower platforms 34, 35. Further, when the upper platform 34 is disposed in either the forward or rearward positions, the detent structure 60 is released, thus allowing unitary movement of the upper platform 34, lower platform 35 and fin 50 along channel 21.

Accordingly, while the upper platform 34 is moved from the forward position to the rearward position, via a rearwardly directed force from the user's foot 11*a*, the detent mechanism 60 detains the position of the lower platform 35 so that the fin 50 is moved from the retracted position to the extended position. When the upper platform 34 is disposed in the rearward position, with the fin 50 disposed substantially in the extended position, the detent mechanism 60 is released and, with a continued rearwardly directed force applied to the upper platform 34, the upper platform 34, lower platform 35 and fin 50, disposed in the extended position, move unitarily rearwardly, from the first position towards the second position, thus propelling the watercraft 10, until the lower platform 35 reaches the rearward terminus of the channel 21.

Likewise, while the upper platform 34 is moved from the rearward position to the forward position, via a forwardly directed force, from the user's foot 11*a*, the detent mechanism 60 is engaged and detains the position of the lower platform 35 so that fin 50 is moved from the extended position to the retracted position. When the upper platform 34 is disposed in the forward position, with the fin 50 disposed substantially in the retracted position, the detent mechanism 60 is released and, with a continued forwardly directed force applied to the upper platform 34, the upper platform 34, lower platform 35, and fin 50, disposed in the retracted position, move unitarily forwardly from the second position to the first position, with minimal affect upon the watercraft's 10 forward propulsion due to the retracted position of the fin 50, until the lower platform 35 reaches the forward terminus of the channel 21.

In an embodiment, the detent mechanism 60 includes a spring actuated frictional braking mechanism 61, such as that disclosed in copending patent application Ser. No. 10/905,257, titled Frictional Brake Mechanism, and filed on Dec. 22, 2004, which is commonly assigned with the present application and which is incorporated herein by reference. The braking mechanism 61 has a brake pad 62 for frictional engagement with the wall of the channel 21 and which is movable to and from braking and non-braking conditions. The braking mechanism 61 is operably coupled to the upper platform 34 with outwardly projecting tang 63, which is integrally coupled with the upper platform 34, adjacent to the inner edge 34*b*, and which extends through oblong lug aperture 42 disposed on the upstanding inner wall 37 of the lower platform 35. In an embodiment, tang 63 is equivalent to the tang structure disclosed in patent application Ser. No. 10/905,257. The oblong aperture 42 is substantially aligned with the braking mechanism 61 in order to effectuate activation and deactivation of the braking mechanism 61 via tang 63, based upon the position of the upper platform 34 relative to the lower platform 35.

A method of propelling a watercraft in a substantially forwardly direction is also disclosed. The method includes providing a vehicle that is slidably coupled to the watercraft and movable to and from first and second positions relative to the watercraft, providing a fin pivotally coupled to the vehicle and pivotable to and from an extended position that is inclined relative to the watercraft when the vehicle is moved from the first position to the second position and a retracted position that is substantially parallel to the watercraft when the vehicle is moved from the second position to the first position, and moving the vehicle from the first position to the second position, thus imparting a forwardly directed propulsion force to the watercraft.

A alternate method of propelling a watercraft includes providing at least two vehicles that are slidably coupled to the watercraft in substantial parallel relation to each other and each being moveable to and from first and second positions relative to the watercraft, providing fins that are respectively pivotally coupled to each vehicle, each fin being pivotable to and from an extended position that is inclined relative to the watercraft when the respective vehicle is moved from the first position to the second position and a retracted position that is substantially parallel to the watercraft when the respective vehicle is moved from the second position to the first position, moving one of the vehicles from the first position to the second position while reciprocally moving the other of the vehicles from the second position to the first position, thus imparting a forwardly directed propulsion force to the watercraft.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A manually propelled watercraft for transporting a user on water, comprising:

a buoyant body having a longitudinal axis and a top side and a bottom side disposed adjacent to the water;

a first track disposed on the body substantially parallel to the longitudinal axis;

a second track disposed on the body in substantial parallel relation to the first track;

a first vehicle slidably coupled to the first track and movable to and from first and second positions relative to the body, the first vehicle includes upper and lower platforms disposed in substantially superimposed relation to each other, each platform having sides and the upper platform being slidable to and from forward and rearward positions relative to the lower platform;

a second vehicle slidably coupled to the second track and movable to and from the first and second positions;

a first fin pivotally coupled to a bottom side of the first vehicle and being pivotable to and from an extended position that is inclined relative to the longitudinal axis and a retracted position that is substantially parallel to the longitudinal axis, wherein when the upper platform is disposed in the forward position, the fin is substantially disposed in the retracted position, and when the upper platform is disposed in the rearward position, the fin is substantially disposed in the extended position; and a second fin pivotally coupled to a bottom side of the second vehicle and being pivotable to and from an extended position that is inclined relative to the longitudinal axis to maximize water resistance for propulsion of the body and a retracted position that is substantially parallel to the longitudinal axis to minimize water resistance;

wherein when the first vehicle is moved from the first position to the second position, the first fin is substantially disposed in the extended position to maximize water resistance for propulsion of the body, and when the first vehicle is moved from the second position to the first position, the first fin is substantially disposed in the retracted position to minimize water resistance.

2. The watercraft as claimed in claim 1 wherein the first track includes a first channel.

3. The watercraft as claimed in claim 1 wherein the upper and lower platforms are substantially oblong and respectively define transversely opposing elongated inner and outer edges, the inner edge being adjacent to the channel.

4. The watercraft as claimed in claim 3 wherein the upper platform has a width that is narrower than a width of the lower platform and the lower platform includes a guide having an inner upstanding wall disposed on the inner edge of the lower platform and an outer upstanding wall transversely disposed on the outer edge of the lower platform.

5. The watercraft as claimed in claim 2 wherein the inner wall includes at least one wheel slidably disposed within the channel.

6. The watercraft as claimed in claim 1 wherein the upper platform includes a foot strap for securing a foot of the user to the upper platform.

7. The watercraft as claimed in claim 1 wherein the lower platform includes an aperture disposed substantially in a middle thereof.

8. The watercraft as claimed in claim 7 wherein the aperture is oblong.

9. The watercraft as claimed in claim 8 wherein the first fin is pivotally coupled to a bottom side of the upper platform and extends through the aperture, wherein a peripheral edge of the aperture abuts the first fin to cause the first fin to pivot from the extended position to the retracted position when the upper platform moves from the rearward position to the forward position and the peripheral edge abuts the first fin to cause the first fin to pivot from the retracted position to the extended position when the upper platform moves from the forward position to the rearward position.

10. The watercraft as claimed in claim 9 wherein the first vehicle includes a detent mechanism for detentable engagement with the first track, the detent mechanism being releasable when the upper platform is disposed substantially in either of the forward position or the rearward position and engageable when the upper platform is disposed between the forward and rearward positions.

11. The watercraft as claimed in claim 10 wherein the detent mechanism includes a spring actuated frictional braking mechanism having a brake pad for frictional engagement with a wall of the first track and being movable to and from braking and non-braking conditions.

12. The watercraft as claimed in claim 11 wherein the brake pad is biased outwardly to the braking condition with a biasing structure.

13. The watercraft as claimed in claim 1 further comprising a substantially upstanding handle bar disposed on the top side of the body, the handle bar being disposed in a position and sized for grasping by the user.

14. The watercraft as claimed in claim 13 further comprising a hand actuated rudder control mechanism disposed on the handle bar and being operably coupled to a rudder structure disposed on the bottom of the body.

15. A manually propelled watercraft for transporting a user along a body of water while the user is in a substantially upright position, comprising:

a buoyant body having a longitudinal axis; and a means for propelling the body in a substantially forwardly directed vector, wherein the means for propelling the body includes a track disposed on the body substantially parallel to the longitudinal axis, a vehicle slidably coupled to the track and movable to and from first and second positions relative to the body, a fin pivotally coupled to a bottom side of the vehicle and being pivotable to and from an extended position that is inclined relative to the longitudinal axis and a retracted position that is substantially parallel to the longitudinal axis, and a means for pivoting the fin to and from the extended and retracted positions, wherein the means for pivoting the fin to and from the extended and retracted positions includes an upper platform and a lower platform having an aperture in a middle thereof, the upper and lower platforms being disposed on the vehicle in substantial superimposed relation to each other, the upper platform being slidable to and from forward and rearward positions relative to the lower platform, the fin being pivotally coupled to a bottom side of the upper platform and extends through the aperture, wherein a peripheral edge of the aperture abuts the fin to pivot the fin from the extended position to the retracted position when the upper platform moves from the rearward position to the forward position and the peripheral edge abuts the fin to pivot the fin from the retracted position to the extended position when the upper platform moves from the forward position to the rearward position.

16. The watercraft as claimed in claim 15 wherein the means for pivoting the fin to and from the extended and retracted positions includes a detent mechanism for engagement with the channel, the detent mechanism being releasable when the upper platform is disposed substantially in either of the forward position or the rearward position and engageable when the upper platform is disposed between the forward and rearward positions.

17. A manually propelled watercraft for transporting a user along a body of water while the user is in a substantially upright position, comprising:

a buoyant body having a longitudinal axis;

a channel disposed on the body substantially parallel to the longitudinal axis;

a vehicle slidably coupled to the channel and being movable to and from first and second positions relative to the body;

a fin pivotally coupled to the vehicle and being pivotable to and from an extended position that is inclined relative to the longitudinal axis and a retracted position that is substantially parallel to the longitudinal axis; and a means for pivoting the fin to and from the extended and retracted positions, wherein the means for pivoting the fin to and from the extended and retracted positions includes an upper platform and a lower platform having an aperture in a middle thereof, the upper and lower platforms being disposed on the vehicle in substantial superimposed relation to each other, the upper platform being slidable to and from forward and rearward positions relative to the lower platform, the fin being pivotally coupled to a bottom side of the upper platform and extends through aperture, wherein a peripheral edge of the aperture abuts the fin to pivot the fin from the extended position to the retracted position when the upper platform moves from the rearward position to the forward position and the peripheral edge abuts the fin to pivot the fin from the retracted position to the extended position when the upper platform moves from the forward position to the rearward position.

18. The watercraft as claimed in claim 17 wherein the means for pivoting the fin to and from the extended and retracted position includes a detent mechanism for detentable engagement with the channel, the detent mechanism being releasable when the upper platform is disposed substantially in either of the forward position or the rearward position and engageable when the upper platform is disposed between the forward and rearward positions.

19. A manually propelled watercraft for transporting a user along a body of water while the user is in a substantially upright position, comprising:

a buoyant body having a longitudinal axis and a top side and a bottom side disposed adjacent to the water;

a track disposed on the body substantially parallel to the longitudinal axis;

a vehicle slidably coupled to the track and movable to and from a first position disposed forwardly relative to the body and a second position disposed rearwardly relative to the body and including upper and lower platforms disposed in substantially superimposed relation to each other, the upper platform being slidable to and from forward and rearward positions relative to the lower platform, the lower platform includes an aperture disposed substantially in a middle thereof; and a fin pivotally coupled to a bottom side of the upper platform and extending through the aperture, wherein when the upper platform is moved from the rearward to the forward position, a peripheral edge of the aperture abuts the fin to cause the fin to pivot from an extended position that is inclined relative to the longitudinal axis to maximize water resistance to a retracted position that is substantially parallel to the longitudinal axis to minimize water resistance, and when the upper platform is moved from the forward position to the rearward position, the peripheral edge abuts the fin to cause the fin to pivot from the retracted position to the extended position.

20. The watercraft as claimed in claim 19 further comprising a detent mechanism for detentable engagement with the track, the detent mechanism being releasable when the upper platform is disposed substantially in either of the forward position or the rearward position and engageable when the upper platform is disposed between the forward and rearward positions.

21. A propulsion mechanism for a watercraft having a longitudinal axis, comprising a vehicle slidably coupled to the watercraft and movable to and from first and second positions relative to the watercraft, the vehicle includes upper and lower platforms disposed in substantial superimposed relation to each other, the upper platform being slidable to and from forward and rearward positions relative to the lower platform; and a fin pivotally coupled to the vehicle and pivotable to and from an extended position that is inclined relative to the longitudinal axis and a retracted position that is substantially parallel to the longitudinal axis;

wherein when the vehicle is moved from the first position to the second position, the fin is substantially disposed in the extended position to maximize water resistance for substantial forward propulsion of the watercraft, and when the vehicle is moved from the second position to the first position, the fin is substantially disposed in the retracted position to minimize water resistance.

22. The propulsion mechanism in claim 21 wherein the lower platform includes an aperture disposed substantially in a middle thereof.

23. The propulsion mechanism as claimed in claim 22 wherein the fin is pivotally coupled to a bottom side of the upper platform and extends through the aperture, wherein a peripheral edge of the aperture abuts the fin to cause the fin to pivot from the extended position to the retracted position when the upper platform moves from the rearward position to the forward position, and the peripheral edge abuts the fin to cause the fin to pivot from the retracted position to the extended position when the upper platform moves from the forward position to the rearward position.

24. The propulsion mechanism as claimed in claim 23 wherein the vehicle includes a detent mechanism for detentable engagement with the watercraft, the detent mechanism being releasable when the upper platform is disposed in either of the forward position or the rearward position and engageable when the upper platform is disposed between the forward and rearward positions.

25. A method of propelling a watercraft, comprising:

providing at least two vehicles that are slidably coupled to the watercraft in substantial parallel relation to each other and each being independently moveable to and from first and second positions relative to the watercraft;

providing fins that are respectively pivotally coupled to each vehicle, each fin being pivotable to and from an extended position that is inclined relative to the watercraft when the respective vehicle is moved from the first position to the second position and a retracted position that is substantially parallel to the watercraft when the respective vehicle is moved from the second position to the first position; and moving one of the vehicles from the first position to the second position while reciprocally moving the other of the vehicles from the second position to the first position.

* * * * *